US007708112B2

(12) United States Patent
Geddes

(10) Patent No.: US 7,708,112 B2
(45) Date of Patent: May 4, 2010

(54) WAVEGUIDE PHASE PLUG

(76) Inventor: Earl Russell Geddes, 43516 Scenic La., Northville, MI (US) 48167

( * ) Notice: Subject to any disclaimer, the term of this patent is extended or adjusted under 35 U.S.C. 154(b) by 281 days.

(21) Appl. No.: 11/272,398

(22) Filed: Nov. 10, 2005

(65) Prior Publication Data

US 2007/0102232 A1 May 10, 2007

(51) Int. Cl.
*G10K 11/04* (2006.01)

(52) U.S. Cl. ..... 181/185; 181/152; 181/177; 381/340; 381/343

(58) Field of Classification Search ..... 181/152, 181/177, 185, 176, 191; 381/75, 339, 340, 381/343, 354; 84/400
See application file for complete search history.

(56) References Cited

U.S. PATENT DOCUMENTS 1,425,318 A * 8/1922 Couturier ..... 84/400
1,907,723 A * 5/1933 Bostwick ..... 381/340
2,058,208 A * 10/1936 Blattner ..... 181/159
3,735,336 A * 5/1973 Long ..... 367/150
3,866,710 A * 2/1975 Cesati ..... 181/159
3,982,607 A * 9/1976 Evans ..... 181/152
4,064,966 A * 12/1977 Burton ..... 181/144
4,390,078 A * 6/1983 Howze et al. ..... 181/185
4,429,762 A * 2/1984 Cesati ..... 181/159
4,776,428 A * 10/1988 Belisle ..... 181/185
4,882,562 A * 11/1989 Andrews et al. ..... 340/388.1
4,893,695 A 1/1990 Tamura
5,046,104 A * 9/1991 Kloss ..... 381/335
5,163,167 A * 11/1992 Heil ..... 181/152
5,815,589 A * 9/1998 Wainwright et al. ..... 381/346
6,026,928 A * 2/2000 Maharaj ..... 181/152
6,377,696 B1 * 4/2002 Nevill ..... 381/345
6,557,664 B1 * 5/2003 Andrews et al. ..... 181/152
6,628,796 B2 * 9/2003 Adamson ..... 381/342
2003/0127280 A1 * 7/2003 Engebretson ..... 181/199
2005/0175208 A1 * 8/2005 Shaw et al. ..... 381/340

OTHER PUBLICATIONS

Meyer Sound Laboratories Specification Document for Model UPA-1A.
Geddes, Audio Transducers, ISBN 0-9722085-0-X.

* cited by examiner

*Primary Examiner*—Jeffrey Donels
*Assistant Examiner*—Jeremy Luks

(57) ABSTRACT

An improved horn for a compression driver which has an interior foam plug for reducing the amplitude of unwanted non-fundamental wave propagation and better control over the sound radiation pattern of the device.

12 Claims, 3 Drawing Sheets

WAVEGUIDE PHASE PLUG

FIELD OF THE INVENTION

The present invention pertains to the improvement in sound quality of a horn or waveguide used for acoustic loading and sound radiation control on an electro-acoustic transducer in an audio loudspeaker system.

BACKGROUND OF THE INVENTION

In the area of audio loudspeakers it is common to use compression drivers for mid to upper frequencies. There are two main reasons for this. First, the compression driver, when coupled to a waveguide (in this application the terms waveguide and horn are synonymous), provides for much higher electro-acoustical efficiency than a direct radiating loudspeaker can achieve. Second, the waveguide provides for better control over the directional characteristics of the sound radiation than can be achieved with a direct radiator loudspeaker. In order to effectively control the sound radiation, the waveguide must be capable of manipulating the sound wavefronts.

The traditional way of manipulating the wavefront is with diffraction. A small gap is placed within the horn which diffracts the wavefront into a very wide angular coverage spherical wave. This wave is then controlled to a specific angle with by the walls of an additional horn section extending out from the diffraction point.

The traditional approach has two major disadvantages. The first is that the diffraction slot causes a large amount of the wavefront to be reflected back down the horn creating a standing wave and an acoustic resonance, which is highly audible as sound coloration. The second disadvantage is that the new diverging wavefront is not composed of a single wave propagation mode, but contains many propagation modes which are created by the diffraction slot.

These "Higher Order Modes" or HOM are highly undesirable because they cause a loss of coherent wavefront propagation resulting in poor sound quality-mostly in terms of the so-called imaging of the sound system. The HOM propagate by reflecting off of the horn walls as they propagate down the device. This is in contrast with the coherent wavefront propagation which does not reflect off of any internal surfaces as it propagates down the device. It is possible for the coherent wavefront energy to be converted into HOM as the wave front propagates. HOM are also created at any slope or area discontinuities within the waveguide.

Not until Geddes showed the presence of the HOM through his work on waveguides (see Chapter 6 of *Audio Transducers*, GedLee Publishing, 2002 ISBN 0-9722085-0-X) was the importance of the HOM within the waveguide recognized. Geddes showed that HOM exist in all waveguides and that they play a significant role in wave propagation in a waveguide at the higher frequencies. In order to control the high frequency polar response one has to control the excitation and propagation of the higher order modes. Clearly the wavefront at the exit aperture of the phase plug, which becomes the horns throat input wavefront should be free from the presence of HOM and this has been addressed by Geddes in his recent patent application Ser. No. 10/919,145. This significant point is missing from the entire body of prior art designs for phase plugs.

Other inventors, most notably Tamura and Sato in U.S. Pat. No. 4,893,695 have recognized the importance of a smooth reflection free transmission characteristic from a waveguide. In their patent the inventors disclose the use of an absorbing member as defining "the acoustic path". Their invention utilizes absorbing material as the actual boundary of the waveguide thereby creating an absorption of the energy bouncing off of the walls. This method does work, but has the disadvantage of requiring a much larger device to accommodate the absorbing boundary. In order to work effectively, the absorbing member must be fairly thick, which causes a large increase in the volume required for the waveguide device.

It is the purpose of this invention to disclose a device which is placed within the boundaries of a waveguide to absorb the HOM as well as any standing waves which may exist within the device that result from reflections from the mouth, etc. The net effect of the use of this device is a substantially improved sound quality for the resulting system.

It has been seen in the marketplace that foam is often placed down the throat of a horn during shipping, presumably to prevent foreign material from entering the device. There is no evidence that this material serves any intended acoustical function and is normally removed prior to usage of the device. There are no teachings that such usage of foam in the throat has any beneficial acoustic effect.

SUMMARY OF THE INVENTION

When one considers the problem of HOMs the first idea would seem to be to make the walls of the waveguide absorptive as in Tamura and Sato (U.S. Pat. No. 4,893,695). This, however, is problematic and less than completely effective. First the walls would have to be made of a soft absorptive material which would have to be fairly thick, thus dramatically increasing the size of the device. Further, absorptive walls would not effectively attenuate the reflected waves that do not intersect the walls. All in all, this idea is found to be impractical and not totally effective.

Given the impracticability of an absorptive wall, the only other feasible concept would appear to be a waveguide with a medium within its boundaries that is something other than air. A medium that has a wave speed other than air is often called refractive, just as glass is a refractive medium for light. This patent application revolves around the idea of using a refractive medium within the boundaries of a waveguide.

Sound absorbing material has often been used at the edges of waveguides (UREI Studio Monitors circa 1980's, models 809-815), or on the front baffle, to affect a variety of sound problems. But none of them placed the material directly in the path of the sound wave, wherein the sound wave was forced to pass through the material, except, as noted above, during shipping for protection.

The use of open cell polyurethane foam placed around a microphone to act as wind screen is well know in the art, and this foam comes in an extremely wide variety of shapes and densities.

By cutting and placing a piece (or pieces) of open cell polyurethane foam within the body of the waveguide, two features of the device can be affected. The first is to attenuation the HOM and the internal standing waves as a result of the high internal damping that the foam presents to the wavefront. The second is that the exit shape of the foam can be tailored to affect the frequency response and the directivity of the waveguide. In this later situation it is the change in the wave speed within the material that affects this wavefront control, much in the same way that the index of refraction of glass affects an optical wavefront in a lens.

In practice it was found that foams in the density of 20 pores per inch (ppi) to 50 ppi resulted in the most desirable characteristics. It was also found that the exit shape should be convex in the preferred embodiment as this gave the smoothest frequency response. The sound level loss that results from the use of a 30 ppi plug in a waveguide designed to operate from 1000 Hz upwards was found to be 2-3 dB, a not insignificant loss, although it can be compensated for in the system design. The loss associated with the HOM and standing waves is expected to be much higher than the loss to the fundamental mode of wave propagation.

The reason that the attenuation of the HOM is greater than the attenuation of the principle mode (the one that does not reflect from the walls) is because the reflected HOM waves travel a greater path length within the lossy material. This is also why these modes are so audible, because they are dispersive, i.e. they travel at a net slower wave velocity down the axis of the device than the principle mode and hence arrive at the listener delayed in time—they are thus incoherent sound.

The same thing is true for the reflections from the mouth, etc. which cause internal standing waves. These waves travel back and forth through the lossy material and are thus readily absorbed.

The foam plug acts to reduce all undesirable sound propagation to a far greater extent than the desired sound, thus creating a considerable increase in the perceived sound quality of devices which incorporate this technology.

DRAWING FIGURES

Figure 1:
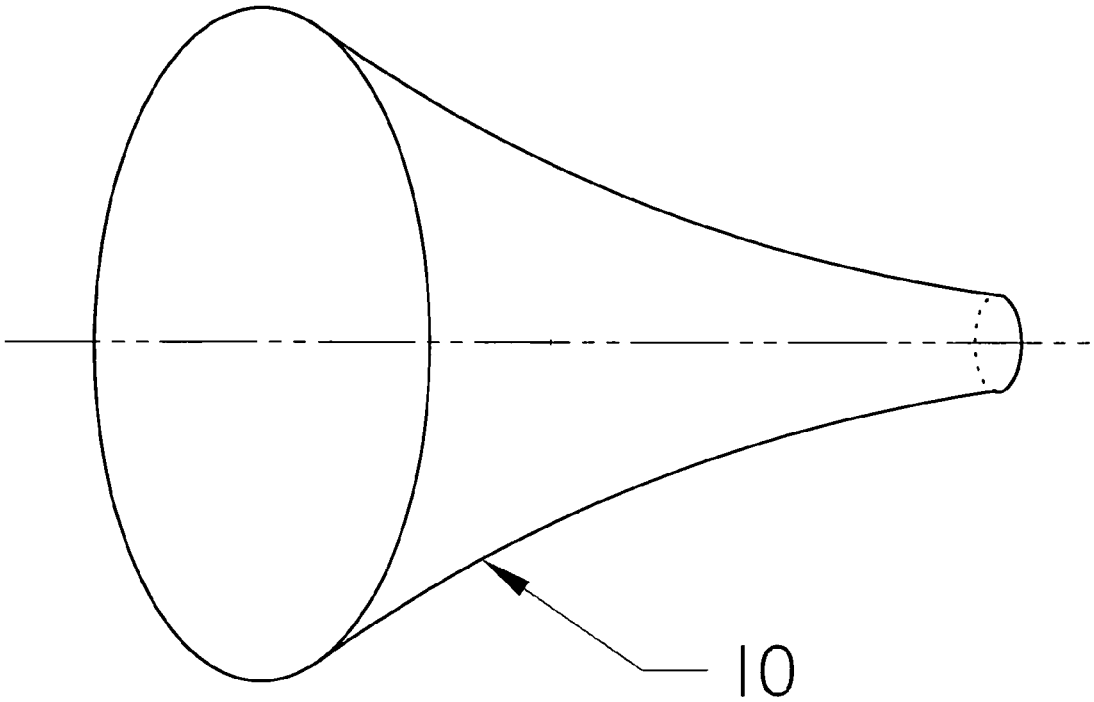
Prior Art Fig. 1
FIG. 1 shows a drawing of the prior art in horn design.
Figure 2:
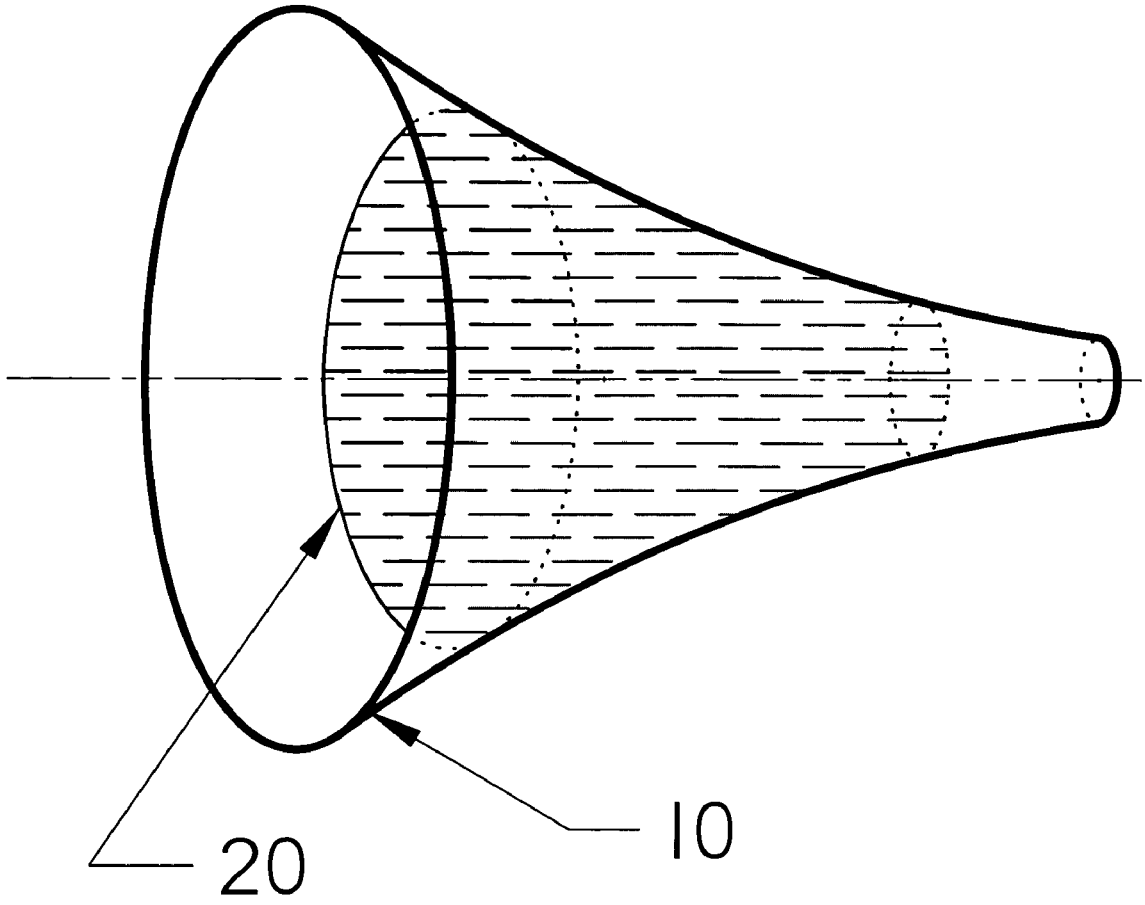
FIG. 2 shows the preferred embodiment of the addition of the refractive material.
Figure 3:
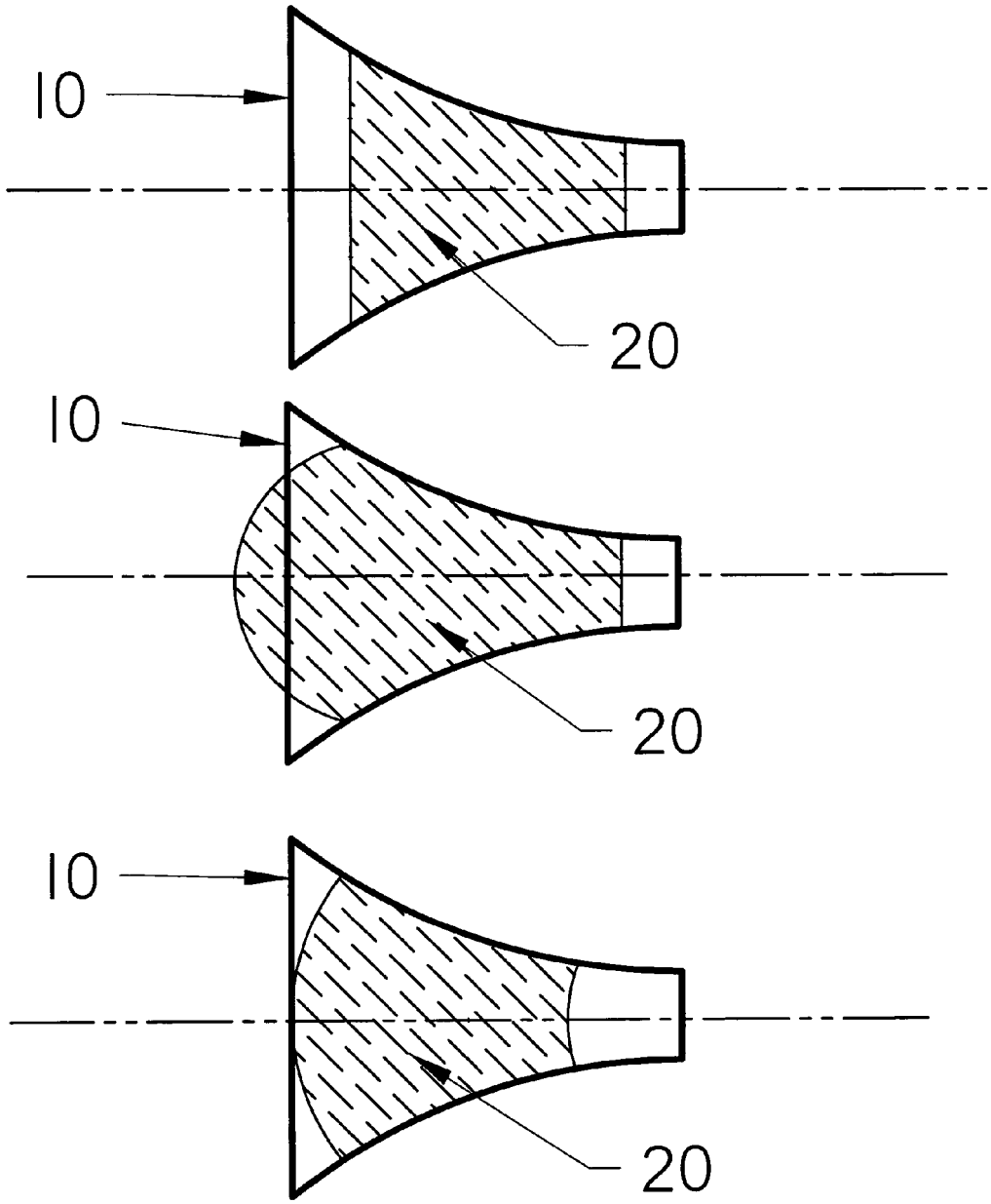
FIG. 3 shows three different configurations of the embodiment of this invention.

| Drawing Numerals | | | |
|---|---|---|---|
| 10 | Horn or waveguide | 20 | Foam plug |

DETAILED DESCRIPTION OF THE PREFERRED EMBODIMENT

It is the purpose of this invention to disclose an improved horn/waveguide for sound radiation.

In the preferred embodiment a piece of open cell polyurethane foam is fabricated so that it fits neatly into the interior of a horn. Shown in FIG. (1), prior art, a horn (10) is filled with air, or said to be unfilled. Shown in FIG. (2) is a preferred embodiment, wherein a portion of the horn (10) is filled with an open cell polyurethane foam (20) such that sound passes through the foam, but is attenuated and delayed by the forced passage through the various channels within the foam.

It is found in practice that a foam density of between 20 to 30 pores per inch (ppi) had the desired amount of attenuation. The greater the number of ppi, the smaller the holes and the greater the attenuation. Too high a value of ppi results in too much attenuation while too low a value of ppi results in almost no effect at all.

FIG. (3) shows several implementations of foam plugs (20) showing how the inlet and outlet of these plugs can be of a variety of shapes. It is also possible that the foam extend outside of the physical bounds of the horn. A feature of this invention is that the foam takes up the majority of the air space within the horn. This is in contrast to the usage of the foam for protection purposes since in this later case the foam takes up only a fractional portion of the total air space within the device. While it is conceivable that small foam plug of a higher density may also work effectively, it is desirable to utilize the lowest possible ppi foam so as to not have a substantial reflection off of the foam. Therefore, the foam plug may fill more than 20% of the volume within the horn.

Other modifications to this approach are possible and will be apparent to those proficient in the art.

I claim:

1. An acoustic horn for a loudspeaker comprising:

a hollow member having an inlet opening and an outlet opening larger than said inlet opening at opposite longitudinal ends, respectively, of said hollow member, wherein said hollow member has an interior wall defining a longitudinally directed conduit open to said inlet and outlet openings at either end, respectively, of said conduit, said conduit having a progressively increasing cross-sectional area along and transverse to a longitudinal axis from the inlet opening to the outlet opening, wherein the inlet-opening end of said conduit is adapted to be acoustically coupled to the front side of a diaphragm or the principle mode output of an electrodynamic audio transducer, and further wherein said interior wall defines progressively divergent waveguide boundaries for cross-sectional expansion of any sound wave passing from the inlet opening to the outlet opening; and, a body of porous refractory material contained in said conduit, said porous material being substantially transparent but partially absorptive to any sound wave directed into said material, wherein the volume of said body is sized to fill more than 20% of the volume of said conduit, and further wherein said body is dimensioned to completely span a cross-sectional area of the conduit between said waveguide boundaries at a longitudinal position of said body within said conduit, and has a convex shape on a surface of the body that faces the outlet opening.

2. The horn of claim 1 wherein:

the porous material fills more than 80% of the interior volume of said conduit.

3. The horn of claim 1 wherein:

the porous material is foam having a porosity in the range of 20 ppi to 50 ppi.

4. The horn of claim 1 wherein:

the porous material is foam having a porosity in the range of 20 ppi to 30 ppi.

5. The horn of claim 1 wherein:

the porous material is foam having a porosity of 30 ppi.

6. The horn of claim 1 wherein:

the porous material is open-cell polyurethane foam.

7. The horn of claim 6 wherein:

said polyurethane foam has a porosity in the range of 20 ppi to 50 ppi.

8. The horn of claim 6 wherein:

said polyurethane foam has a porosity in the range of 20 ppi to 30 ppi.

9. The horn of claim 6 wherein:

said polyurethane foam has a porosity of 30 ppi.

10. The horn of claim 1 wherein:

the porous material extends outside of said conduit through the outlet opening of said hollow member.

11. The horn of claim 1, wherein:

the inlet-opening end of said conduit is adapted to be acoustically coupled to the outlet of a compression driver.

12. An acoustic horn for a loudspeaker comprising:

a hollow member having an inlet opening and an outlet opening larger than said inlet opening at opposite longitudinal ends, respectively, of said hollow member, wherein said hollow member has an interior wall defining a longitudinally directed conduit open to said inlet and outlet openings at either end, respectively, of said conduit, said conduit having a progressively increasing cross-sectional area along and transverse to a longitudinal axis from the inlet opening to the outlet opening, wherein the inlet-opening end of said conduit is adapted to be acoustically coupled to the front side of a diaphragm or the principle mode output of an electrodynamic audio transducer, and further wherein said interior wall defines progressively divergent waveguide boundaries for cross-sectional expansion of any sound wave passing from the inlet opening to the outlet opening; and, a body of porous refractory material contained in said conduit, said porous material being substantially transparent but partially absorptive to any sound wave directed into said material, wherein the volume of said body is sized to fill more than 20% of the volume of said conduit, and further wherein said body is dimensioned to completely span a cross-sectional area of the conduit between said wave guide boundaries at a longitudinal position of said body within said conduit, and is further dimensioned such that its longitudinal span is sufficient to present a path length to any HOM wave created within said hollow member that is longer than any path length for any principle mode wave within said body.

* * * * *